United States Patent [19]

Andou et al.

[11] Patent Number: 4,974,975

[45] Date of Patent: Dec. 4, 1990

[54] ARMATURE OF PRINTING HEAD FOR USE IN WIRE PRINTER

[75] Inventors: Hirokazu Andou; Kiyoshi Ikeda; Eisaku Muto, all of Tokyo, Japan

[73] Assignee: Oki Electric Industry Co., Ltd., Tokyo, Japan

[21] Appl. No.: 400,052

[22] Filed: Aug. 29, 1989

[30] Foreign Application Priority Data

Sep. 1, 1988 [JP] Japan ..... 63-114086[U]

[51] Int. Cl.[5] ..... B41J 2/25

[52] U.S. Cl. ..... 400/124; 101/93.05; 400/121

[58] Field of Search ..... 400/124, 149, 152, 160, 400/118, 121, 139; 101/93.05, 93.41, 93.29, 93.34, 93.48, 93, 93.04, 93.18, 93.21, 93.28, 93.47

[56] References Cited

U.S. PATENT DOCUMENTS

| | | | |
|---|---|---|---|
| 4,394,093 | 7/1983 | Asano et al. | 400/124 |
| 4,403,875 | 9/1983 | Asano et al. | 400/124 |
| 4,767,226 | 8/1988 | Sakaida et al. | 400/124 |
| 4,822,188 | 4/1989 | Shimojo et al. | 400/124 |

FOREIGN PATENT DOCUMENTS

| | | | |
|---|---|---|---|
| 56-174 | 1/1981 | Japan | 400/124 WD |
| 58-49275 | 3/1983 | Japan | 400/124 WD |
| 60-219067 | 11/1985 | Japan | 400/124 WD |
| 0269959 | 11/1987 | Japan | 400/124 |

*Primary Examiner*—Edgar S. Burr
*Assistant Examiner*—Motilal P. Patel
*Attorney, Agent, or Firm*—Wenderoth, Lind & Ponack

[57] ABSTRACT

An armature device of a printing head for use in a wire printer includes stylus having a free end to strike a recording medium, an armature connected to the stylus for reciprocating the stylus in a longitudinal direction thereof, a permanent magnet for generating a magnetic flux, a core for conducting the magnetic flux into the armature to form a magnetic path, a coil winding wound around the core for selectively substantially cancelling the magnetic flux, and a spring member having a free end supporting the armature for spring biasing the armature away from the core. The armature has a generally elongated shape, and a transverse groove formed in an end portion of the armature. The end portion of the armature has a first portion forming one wall of the groove and a second portion forming the other wall of the groove, the first and second portions opposing each other along the longitudinal direction of the armature. One of the walls is higher than the other wall. The stylus has a fixed end portion housed and bonded in the groove, with an end surface facing a bottom of the groove.

21 Claims, 3 Drawing Sheets

ARMATURE OF PRINTING HEAD FOR USE IN WIRE PRINTER

BACKGROUND OF THE INVENTION

1. Field of the Invention

The present invention relates to a wire printing head for a stylus or wire printer, and in particular, to an armature therefor and a mechanism for driving the armature.

2. Description of the Prior Art

Conventionally, various types of printing heads including plunger type and clapper type printing heads, have been employed in stylus printers. In order to provide a satisfactory high-speed response, such wire printing heads normally include a spring biasing mechanism. This type of printing head generally includes a printing head having an armature, a printing wire, a leaf spring, a permanent magnet, a core, a coil winding, and a stylus having a free end. The armature is provided with a length of wire (i.e. a stylus) fixed thereto and is swingably supported by the leaf spring which provides bias thereto. The permanent magnet attracts the armature toward the core against the bias of the leaf spring. In a printing operation, the coil winding disposed around the core is excited to produce a magnetic flux in a direction opposite to one associated with the permanent magnet so as to cancel the magnetic flux of the permanent magnet. The armature is thus released from the magnetic force of the permanent magnet so as to cause the free end of the stylus to hit a platen. As shown in FIG. 5, the stylus 2 is connected at an end 21 thereof to an end portion of the armature 18 which is thinner than the opposite end portion of the armature. The printing wire is bonded or brazed on the extreme end of end portion 19*a*.

However, a recent improvement in the printing speed tends to increase a load imposed on the brazed connection between the armature and the stylus. In order to obtain higher printing speeds, the armature must be of a reduced weight. This generally requires that the area of the brazed connection be decreased.

With the armature of the conventional wire printing head, the printing wire is simply fixed to the end of the armature. Consequently, it is difficult to obtain a sufficient bonding strength between the armature and the stylus. Thus, during operation of the printing head in which the printing impact is repeatedly exerted, the printing wire may become separated from the armature.

SUMMARY OF THE INVENTION

It is therefore an object of the present invention to provide an armature mechanism for a wire printing head in which a shearing force acting upon the printing wire is mitigated to prevent the wire from becoming separated from the end of the armature, to thereby provide for reliable printing.

An armature device of a printing head for use in a wire printer in accordance with the present invention comprises a stylus having a free end adapted to strike a recording medium to provide printing, an armature connected to the stylus for reciprocating the stylus in a longitudinal direction thereof, a permanent magnet for generating a magnetic flux, a core for conducting the magnetic flux into said armature to form a magnetic path, a coil winding wound around said core for selectively substantially cancelling the magnetic flux, and a spring member having a free end supporting the armature for spring biasing the armature away from the core. The armature is generally elongated and has an end portion in which a transverse groove is formed. The end portion of the armature includes a first portion forming one transverse wall at one side of the groove, and a second portion forming the other transverse wall of the groove. One of the walls is higher than the other wall. The stylus has a second end portion opposite the free end thereof housed in said groove, with an end surface facing a bottom of the groove and bonded therein.

BRIEF DESCRIPTION OF THE DRAWINGS

The objects and features of the present invention will become more apparent from the following detailed description taken in conjunction with the accompanying drawings in which.

DESCRIPTION OF THE PREFERRED EMBODIMENTS

Figure 1:
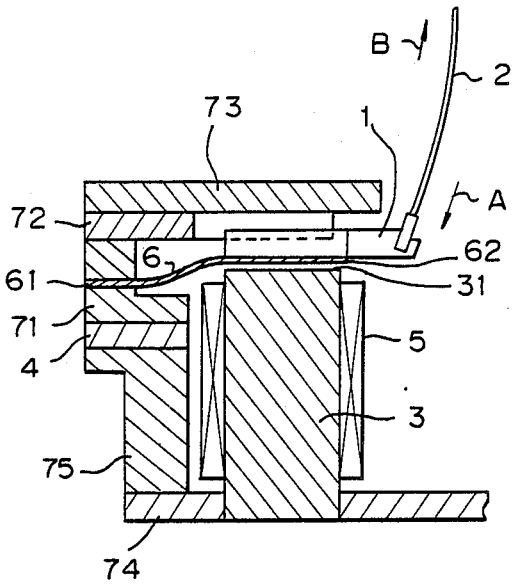
FIG. 1 is a partly cross-sectional view schematically showing an embodiment of a printing head with an armature in accordance with the present invention.

FIG. 1 shows a cross-sectional view of an embodiment of a printing head adapted for use in a wire or stylus printer in accordance with the present invention. The armature mechanism of the embodiment shown in this figure includes an armature 1 having an end on which a stylus 2 is fixed. The wire 2 is adapted to strike a printing medium, not shown, via an ink ribbon, not shown, to print a dot forming part of a letter or figure to be printed on the printing medium. The armature 1 is swingably supported on a yoke member 71 by means of a leaf spring 6. The yoke member 71 is a magnetic member which forms, together with other magnetic yoke members 72, 73 and 74, a body which defines a magnetic path for a magnetic flux of a permanent magnet 4 mounted thereto to attract the armature 1 to a core 3. The body formed by yokes 71–74 has a generally C-shaped contour when viewed from a side thereof. On the lowest yoke 74 is attached the core 3 which is also formed of a magnetic material. A coil winding 5 is wrapped about the core 3. The permanent magnet 4 is supported on the yoke 75 as shown in FIG. 1 to constantly generate a magnetic field which attracts the armature 1 toward the core 3. The coil winding 5 is wound around the core 3 in a direction such that the coil winding 5, when powered, produces a magnetic flux substantially cancelling the magnetic flux generated by the permanent magnet. The armature 1 is supported by the leaf spring 6 in a cantilever fashion and spring biased away (i.e. upward) from the core 3, by the spring 6. The armature 1 is swingable about a support section 61 of the spring 6. When the coil winding 5 is not powered, the magnetic attractive force produced by the permanent magnet 4 attracts the armature toward an end surface 31 of the core 3 against the elastic force of the leaf spring 6.

Figure 2:
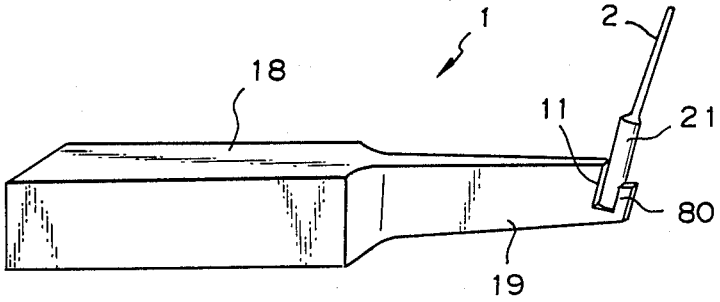
FIG. 2 is a perspective view showing the armature and stylus according to the embodiment of FIG. 1.
Figure 3:
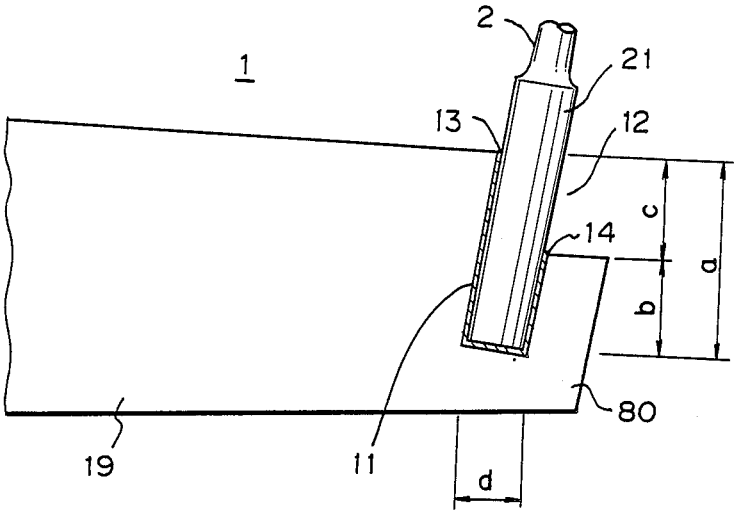
FIG. 3 is a magnified side view showing an end portion of the armature of the embodiment of FIG. 1.

The armature 1 comprises, as shown in FIG. 2, a base portion 18 having a thickness (in the transverse direction of the armature) which is greater than the thickness of a portion 19 which extends therefrom. The thicker portion 18 is supported on the free end 62 of the leaf spring 6. The stylus is fixedly attached to the end of the portion 19 of the armature 1. FIG. 3 shows a magnified view of the portion 19.

As shown in FIG. 3, in the proximity of an edge 80 of the end portion 19 of the armature 1, a groove 11 is formed. An end portion 21 of the printing wire 2 is adapted to be fixedly bonded within the groove 11. The groove 11 extends transversely to the longitudinal direction of the armature (i.e. normal to the sheet of FIG. 3). The groove 11 has opposing ends opening through respectively opposite longitudinally extending sides of the armature 1. As shown in FIG. 3, the groove 11 divides the end portion 19 of armature 1 into a first portion 30 and a second portion 40, the first portion 30 extending higher than the second portion 40 and being disposed to the left of the groove 11. In a preferred example, the end portion 19 has a thickness (in the transverse direction of the armature) of about 0.2 millimeters (mm) to about 0.3 mm. Thus, the groove 11 is short in the transverse direction of the armature compared with its depth. The first and second portions are configured to form a step therebetween. The stylus 2 has its end 21 fixed in the groove 11 with, for example, silver soldered bonded portions 13 and 14. The fixed end 21 of the stylus 2 also has a diameter of about 0.2 mm to about 0.3 mm.

Figure 5:
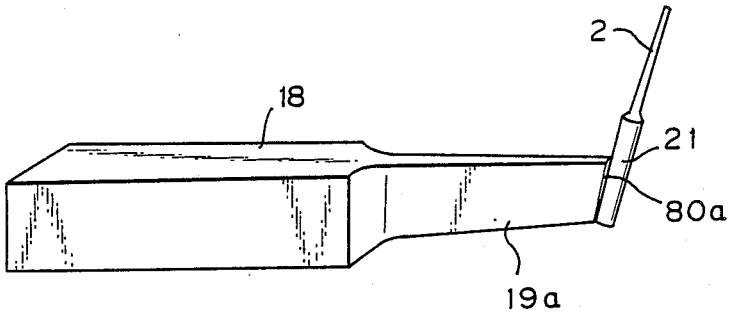
Fig. 5 PRIOR ART
FIG. 5 is a perspective view showing, in a similar fashion as FIG. 2, an example of a prior art armature for use in a stylus printer.

As shown in FIG. 3, the depth of the groove 11 is given by a and b with respect to the first and second portions, respectively, and the difference in depths is given by c. Furthermore, the width of the groove 11 in the longitudinal direction of the armature 1 is given by d. Thus, a length equal to $a+b+d$ is subjected to brazing with, for example, silver solder at bonded portions 13, 14 when the stylus 2 is bonded into groove 11. Therefore, the bonding or brazing area is increased as compared with the prior art. As mentioned previously, FIG. 5 shows a perspective view of a conventional armature mechanism in which a printing wire 2 is fixedly bonded to an armature 1. In this mechanism, an end portion **19*a* of the armature 1 has an edge 80*a* terminating in a simple flat plane. To the flat plane is brazed a fixed portion 21 of the stylus 2** with silver solder. In this arrangement, it is difficult to develop a bonding strength sufficient to withstand repeated printing impact such that the reliability of the device is not satisfactory.

If the only object was to increase the bonding strength between the stylus 2 and the armature 1, the depth b of the groove 11 with respect to the second portion 40 of the portion 19 could be made substantially equal to the depth a relative to the first portion 30 of the portion 19 so as to omit the step 12. If this were done, however, a shearing force applied to the stylus 2 by the printing impact would be concentrated on one of the bonded portions 13, 14, which could cause the stylus 2 to break at a position corresponding to that bonded portion. Therefore, in accordance with the present invention, the step 12 is formed to provide the two bonded portions 13 and 14, thereby reducing the chance that the stylus 2 will break.

Figure 4:
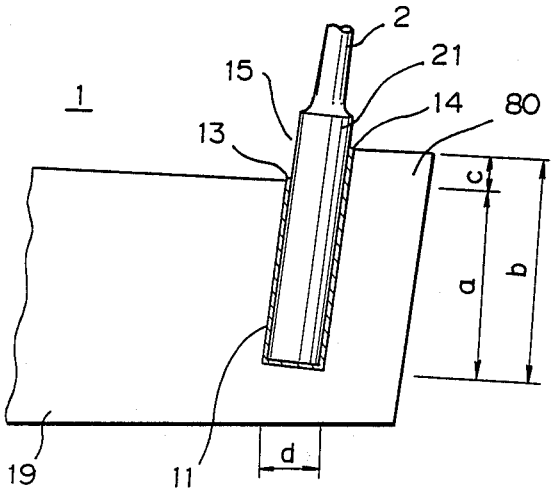
FIG. 4 is an enlarged side view showing, an armature in accordance with an alternative embodiment of the present invention.

FIG. 4 shows a side view of a portion 119 of an alternative embodiment of the armature in accordance with the present invention. In FIG. 4, components or structural elements similar to those in FIGS. 1–3 are designated by the same reference numerals incremented by 100, and redundant description will be avoided for simplicity. In this embodiment, an armature 101 has a groove 111 of a depth b′ with respect to a first portion 130 (disposed to the right of groove 111 in FIG. 4) which is greater than a depth a′ of the groove 111 with respect to a second portion 140, to thereby form a step 112. That is, the step 112 is formed with its lower portion to the left in FIG. 4. In contrast, in the embodiment shown in FIG. 3, the step 12 is formed with its lower portion to the right. In the structure of FIG. 4, the depth b′ contributes more to enhancing the bonding strength of the stylus 2. However, the increased mass of the first portion 130 due to the greater depth b′ may hinder high-speed operation of the armature 1.

Returning to FIG. 1, in operation, when the coil winding 5 is not excited, the magnetic flux of the permanent magnet 4 passes through the yokes 71, 72 and 73, the armature 1, the core 3, and the yokes 74 and 75. As a result, a magnetic force attracts the armature 1 toward the core 3 in a direction A against the bias of leaf spring 6, thereby distorting the leaf spring 6.

Subsequently, when the coil 5 is excited, the magnetic flux produced by the coil winding 5 cancels the flux generated by the permanent magnet 4 so as to release the leaf spring 6 from the distorted or biased state. This drives the stylus 2 in the direction B, the stylus being fixedly attached in the groove 11 of the armature 1. The free end of the stylus 2 then strikes the printing medium, not shown, via the ink ribbon, not shown.

The printing head of a stylus printer has a plurality of such armature mechanisms. Free ends of the styluses 2 of the armature mechanisms are linearly arranged to form a dot-matrix printing line. The coil windings 5 of the armature mechanisms are selectively excited while moving the printing head relative to a platen, not shown, so as to produce a line of print.

In accordance with the present invention, in the proximity of an end of the armature is disposed a groove having opposite walls of different heights so as to form a step between first and second portions of the armature. The stylus is fixed in the groove so as to increase the bonding area between the groove and the printing stylus as compared with printing mechanisms of the prior art. Consequently, in the present invention, the bonding force is sufficient to withstand impact applied to the end portion of the armature during a printing operation. Thus, the stylus is prevented from being separated from the armature. In addition, due to the formation of the step, the shearing force applied by the printing impact of the stylus is not concentrated on only one bonded portion. This prevents breakage of the wire at the bonded portion. Therefore, the printing head of the present invention provides reliable printing even during high speed operation.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A printing head comprising:

an elongated stylus having a first free end which is adapted to strike a recording medium and a second end;

a generally elongated armature secured to said second end of said stylus and having a first end with an end portion defined adjacent thereto and a second end, an elongated groove being formed in said armature to receive said second end of said stylus, said groove extending transversely of said elongated armature and having two walls formed transversely of said armature along respective sides of said groove and opposing each other along the longitudinal direction of said elongated armature, a first portion of said armature being defined on one side of said groove and a second portion of said armature being defined on the opposing side of said groove, each of said two walls being of substantially different heights such that a stepped portion is formed in said end portion of said elongated armature and such that a longitudinal extension line coextensive with a top of one of said first and second portions is higher than a longitudinal extension line coextensive with a top of the other of said first and second portions;

means for generating a magnetic flux;

means, comprising a core, for conducting the magnetic flux to said armature so as to attract said armature toward said core;

means comprising a spring member having a free end mounted to said armature, for biasing said armature away from said conducting means; and means for selectively cancelling the magnetic flux so as to allow said biasing means to move said armature away from said core and thereby cause said free end of said stylus to strike the recording medium.

2. A printing head as recited in claim 1, wherein said second end of said stylus faces a bottom of said groove.

3. A printing head as recited in claim 2, wherein said second end of said stylus is bonded into said groove.

4. A printing head as recited in claim 3, wherein said stylus is further bonded into said groove along said two walls thereof.

5. A printing head as recited in claim 1, wherein said generating means comprises a permanent magnet.

6. A printing head as recited in claim 1, wherein said cancelling means comprises a coil winding wound about said core.

7. A printing head as recited in claim 1, wherein said spring member comprises a leaf spring.

8. A printing head as recited in claim 1, wherein said first portion of said armature is higher than said second portion of said armature and is defined on the side of said groove closer to said second end of said armature.

9. A printing head as recited in claim 8, wherein a base portion of said armature is defined adjacent said second end of said armature and is integrally formed contiguously with said first portion of said armature, said first portion of said armature being thinner than said base portion of said armature in the transverse direction of said armature.

10. A printing head as recited in claim 9, wherein said first portion is of substantially the same thickness as said stylus in the transverse direction of said armature.

11. A printing head as recited in claim 1, wherein said second portion of said armature is lower than said first portion of said armature and is defined on the side of said groove closer to said second end of said armature.

12. A printing head as recited in claim 11, wherein a base portion of said armature is defined adjacent said second end of said armature and is integrally formed contiguously with said second portion of said armature, said second portion of said armature being thinner than said base portion of said armature in the transverse direction of said armature.

13. A printing head as recited in claim 12, wherein said second portion is of substantially the same thickness as said stylus in the transverse direction of said stylus.

14. A printing head as recited in claim 11, further comprising a body, said body supporting said core and being formed of a magnetic material such that it can cooperate with said core in conducting magnetic flux, and said armature being mounted between said core and a portion of said body.

15. A printing head as recited in claim 14, wherein said generating means comprises a permanent magnet, and said permanent magnet is mounted on said body.

16. A printing head as recited in claim 14, wherein said spring member has a fixed end mounted to said body.

17. A printing head comprising a plurality of armatures and a plurality of styluses as recited in claim 1, wherein the free ends of said styluses are arranged such that they form a print line for printing a dot-matrix.

18. A printing head as recited in claim 1, wherein said groove includes opposite ends opening through respectively opposite longitudinally extending sidewalls of said armature.

19. An apparatus for a printing head, comprising:

an elongated stylus having a first free end which is adapted to strike a recording medium and a second end; and a generally elongated armature secured to said second end of said stylus and having a first end with and end portion defined adjacent thereto and a second end, an elongated groove being formed in said armature to receive said second end of said stylus, said groove extending transversely of said elongated armature and having two walls formed transversely of said armature along respective sides of said groove and opposing each other along the longitudinal direction of said elongated armature, a first portion of said armature being defined on one side of said groove and a second portion of said armature being defined on the opposing side of said groove, each of said two walls being of substantially different heights such that a stepped portion is formed in said end portion of said elongated armature and such that a longitudinal extension line coextensive with a top of one of said first and second portions is higher than a longitudinal extension line coextensive with a top of the other of said first and second portions.

20. A printing head as recited in claim 19, wherein said first portion of said armature is higher than said second portion of said armature and is defined on the side of said groove closer to said second end of said armature.

21. A printing head as recited in claim 19, wherein said second portion of said armature is lower than said first portion of said armature and is defined on the side of said groove closer to said second end of said armature.

* * * * *